United States Patent [19]

Umemura et al.

[11] Patent Number: 4,709,554

[45] Date of Patent: Dec. 1, 1987

[54] AIR CONDITIONING APPARATUS

[75] Inventors: Hiroyuki Umemura; Kenji Matsuda; Tomofumi Tezuka; Kazuaki Isono; Hidenori Ishioka, all of Shizuoka; Fumio Matsuoka, Kamakura; Hitoshi Iijima, Amagasaki, all of Japan

[73] Assignee: Mitsubishi Denki Kabushiki Kaisha, Tokyo, Japan

[21] Appl. No.: 898,492

[22] Filed: Aug. 21, 1986

[30] Foreign Application Priority Data

| | | | |
|---|---|---|---|
| Aug. 22, 1985 | [JP] | Japan | 60-184901 |
| Aug. 22, 1985 | [JP] | Japan | 60-184904 |
| Aug. 22, 1985 | [JP] | Japan | 60-184905 |
| Oct. 15, 1985 | [JP] | Japan | 60-229074 |
| Nov. 28, 1985 | [JP] | Japan | 60-267825 |
| Nov. 28, 1985 | [JP] | Japan | 60-267826 |

[51] Int. Cl.[4] ..... F25D 21/06

[52] U.S. Cl. ..... 62/156; 62/155; 62/228.4; 62/278

[58] Field of Search ..... 62/151, 155, 156, 160, 62/158, 234, 228.4, 81, 278

[56] References Cited

U.S. PATENT DOCUMENTS

| | | | |
|---|---|---|---|
| 4,406,133 | 9/1983 | Saunders et al. | 62/156 X |

FOREIGN PATENT DOCUMENTS

| | | | |
|---|---|---|---|
| 57-49093 | 10/1982 | Japan . | |
| 0115235 | 7/1983 | Japan | 62/156 |
| 0069445 | 4/1985 | Japan | 62/155 |
| 0082735 | 5/1985 | Japan | 62/155 |
| 0144548 | 7/1985 | Japan | 62/156 |

*Primary Examiner*—Harry Tanner

*Attorney, Agent, or Firm*—Oblon, Fisher, Spivak, McClelland, & Maier

[57] ABSTRACT

An air conditioning apparatus comprises a refrigerant circuit in which a compressor, a four-way valve, a room side heat exchanger, a pressure-reducing device and an outdoor side heat exchanger are connected in this order, wherein there is provided with a refrigerant temperature detector provided at a pipe line near the outdoor side heat exchanger, a room temperature detector for detecting temperature of a room and a controlling device which is electrically connected to the refrigerant temperature detector and the room temperature detector, said controlling device controlling operations for room-warming and defrosting based on inputs from the detectors.

7 Claims, 35 Drawing Figures

AIR CONDITIONING APPARATUS

The present invention relates to an air conditioning apparatus capable of removing frost in an outdoor side heat exchanger while room-warming operation is carried out.

FIG. 1 shows a conventional air conditioning apparatus. In the Figure, a reference numeral 1 designates a compressor, a numeral 2 designates a four-way valve, a numeral 3 designates a room side heat exchanger, a numeral 4 designates a capillary tube for room-warming operation, a numeral 5 designates an outdoor side heat exchanger, a numeral 6 designates an accumulator, a numeral 7 designates a capillary tube for cooling and defrosting operations, numerals 8 and 9 designate check valves, numerals 10 and 11 designate first and second temperature detectors respectively provided at the inlet and outlet sides of pipings connected to the outdoor side heat exchanger 5, and a numeral 12 designates a controlling device which is electrically connected to the first and second temperature detectors 10, 11; possesses the function of a timer, and outputs a signal to change operations from room-warming to defrosting and vice versa.

The operation of the conventional apparatus will be described.

During the room-warming operation, a refrigerant discharged from the compressor 1 is passed through the four-way valve 2, the room side heat exchanger 3, the check valve 8, the capillary tube 4 for room-warming, the outdoor side heat exchanger 5 to be returned to the compressor 1 via the accumulator 6 after it has again been passed through the four-way valve 2.

In the defrosting operation, the refrigerant discharged from the compressor 1 flows through the four-way valve 2, the outdoor side heat exchanger 5, the check valve 9, the capillary tube 7 for defrosting (cooling), and the room side heat exchanger 3 to return to the compressor 1 via the four-way valve 2 and the accumulator 6; thus a cycle of circulation is formed.

In the room-warming operation, an integrating timer of the controlling device 12 counts time $t_1$ lapsed during the room-warming. The controlling device 12 compares the time $t_1$ with defrost prohibiting time $t_{DS}$ set in the controlling device 12 and compares the temperature $T_1$ of a piping which is detected by the first temperature detector 10 with a defrost initiating temperature $T_S$. In this case, when $t_1 > t_{DS}$ and $T_1 < T_S$, the controlling device outputs a signal to change to the defrosting operation, while when $t_1 > t_{DS}$ and $T_1 > T_S$, the room-warming operation is continued.

In the defrosting operation, the integrating timer counts time $t_2$ lapsed in the defrosting operation, and the controlling device 12 compares the time $t_2$ with the longest defrosting time $t_{Dmax}$ set in the controlling device 12 and compares a temperature $T_2$ of the piping which is detected by the second temperature detector 11 with a defrost ending temperature $T_E$. When the condition that $T_2 > T_E$ or $t_2 > t_{Dmax}$ provided $T_2 < T_E$ is established, the controlling device outputs a signal for changing to the room-warming operation.

Accordingly, in the conventional apparatus, the timing, usually fixed, for changing from the room-warming operation to the defrosting operation is determined by the defrost prohibiting time. Accordingly, the defrosting operation starts even when an amount of frost deposited in the outdoor side heat exchanger is small and the defrosting operation is unnecessary. On the contrary, even though a large amount of the frost remains due to presence of the maximum defrosting time the room-warming operation is started.

Thus, in the conventional air conditioning apparatus having a fixed defrost prohibiting time $t_{DS}$ and the maximum defrosting times $t_{Dmax}$, there remains frost in the outdoor side heat exchanger even after the defrosting operation. Accordingly, efficient operation can not be obtained. In the worst case, a large amount of the remaining frost renders the air conditioning apparatus inoperable.

When the refrigerant temporarily flows in the reverse direction during the defrosting operation, there is a quiescent time for the room-warming operation and therefore, a room temperature may be reduced during the defrosting operation.

FIG. 2 is the diagram of a controlling circuit in the defrosting operation of a conventional heat-pump type air conditioning apparatus disclosed in, for instance, Japanese Unexamined Utility Model Publication No. 490393/1982. In FIG. 2, the same reference numerals as in FIG. 1 designate the same or corresponding parts.

When a defrosting condition detector whose temperature sensitive part is in contact with a pipe connected to the inlet side of the outdoor side heat exchanger outputs a detecting signal, the contact **13*a* or 13*b* in a changing switch 13 is operated. The contact 13*a* of the changing switch 13 is a normally closed contact. When the defrosting condition detector outputs the detection signal, the contact 13*a* is opened and the contact 13*b* is closed. The contact 13*a* is connected to one side of the terminals 15 of a power source through a serial connection of the driving coil of the four-way valve 2 and one of switches 14 for room-warming operation. Similarly, the contact 13*b* is connected to the one of the terminals 15 of the power source through a relay 16 and the other switch 14. The movable contact of the changing switch 13 is connected to the other terminal 15 of the power source. Between the terminals 15 of the power source, a serial connection of a normally closed contact 16*a* of the relay 16, a fan 17 for the room side heat exchanger 3 and a blowing rate regulating switch 18 is connected in parallel to the serial connection of the changing switch 13, relay 16 or the driving coil 2*a* and the switch 14**.

During the room-warming operation, the switch 14 for the room-warming is closed to excite the driving coil **2*a* of the four-way valve whereby the four-way valve 2 is operated for the room-warming operation. Then, a high temperature, high pressure gas discharged from the compressor 1 is supplied through the four-way valve 2 to the room side heat exchanger 3 where it is cooled by air forcibly fed by the fan 17. The refrigerant liquefied in the room side heat exchanger is supplied to a pressure reducing device 4 where it undergoes adiabatic expansion to become a low pressure refrigerant. The low pressure refrigerant evaporates in the outdoor side heat exchanger 5 by the heat of air forcibly blown by the fan for the outdoor side heat exchanger to become a low pressure gas. The low pressure gas is then sucked into the compressor 1 through the four-way valve 2. In the recycling of the refrigerant, when the atmospheric temperature decreases, a calorie to be taken from the outdoor side heat exchanger 5 to the refrigerant circuit also decreases. When the temperature of the evaporation decreases and it is below 0° C., deposition of frost starts in the outdoor side heat exchanger 5. The frost causes reduction in capability of taking up the heat in the refrigerant. Accordingly, the temperature of the pipe at the inlet side of the outdoor side heat exchanger 5 further decreases and it becomes a temperature lower than a predetermined temperature. When the temperature of the pipe at the inlet side of the heat exchanger 5 is below the predetermined temperature, it is detected by the defrosting condition detector provided on the pipe near the inlet side of the heat exchanger 5 whereby the contact 13***a* of the changing switch 13 is opened. Accordingly, the driving coil 2*a* is deenergized to move the four-way valve 2 so that the refrigerant circuit is changed to cooling mode.

Simultaneouly, the contact 13*b* is closed to excite the relay 16. The excitation of the relay 16 opens the normally closed contact 16*a*. Then, the fan 17 for the room side heat exchanger is stopped so that cool air is not blown from the room side heat exchanger 3. In this case, any contact arm in the blowing rate regulating switch 18 is closed. Thus, when the four-way valve 2 is operated to change the operation to cooling mode, the high temperature, high pressure refrigerant gas discharged from the compressor 1 is directly entered in the outdoor side heat exchanger 5 through the four-way valve 2 to dissolve the frost deposited in the heat exchanger by the heat of the refrigerant.

On completion of the defrosting, the temperature of the temperature sensitive part of the defrosting condition detector 13 increases. Then, the contact 13*a* of the changing switch 13 is closed, while the contact 13*b* is opened, whereby the coil 2*a* of the four-way valve 2 is excited again and the four-way valve 2 is operated so that the operation is returned to room-warming mode.

In the conventional air conditioning apparatus, however, the room-warming operation was not carried out during the defrosting operation or for a certain time after the restarting of the room-warming operation. Accordingly, an occupant felt uncomfortableness due to reduction in the room temperature.

It is an object of the present invention to provide an air conditioning apparatus which provides a highly efficient operation, improves comfortableness for an occupant in a room by effecting defrosting operation at an optimun timing and does not affect the defrosting operation if there remains frost in the outdoor side heat exchanger.

The present invention is to provide an air conditioning apparatus comprising a refrigerant circuit in which a compressor, a four-way valve, a room side heat exchanger, a pressure-reducing device and an outdoor side heat exchanger are connected in this order, characterized by comprising a refrigerant temperature detector provided at a pipe line near the outdoor side heat exchanger, a room temperature detector for detecting temperature of a room and a controlling device which is electrically connected to the refrigerant temperature detector and the room temperature detector and which controls operations for room-warming and defrosting based on inputs from the detectors.

The present invention also provides an air conditioning apparatus comprising a refrigerant circuit in which a compressor, a four-way valve, a room side heat exchanger, a pressure-reducing device and an outdoor side heat exchanger are connected in this order, characterized by comprising a first check valve interposed between the discharge side of the compressor and the four-way valve, a refrigerant pipe line for connecting the discharge side of the compressor to the inlet side of the outdoor side heat exchanger in the case of room-warming operation, an electromagnetic valve disposed in the refrigerant pipe line and a defrosting condition detector for detecting a temperature for which a defrosting operation is started for said outdoor side heat exchanger, wherein the electromagnetic valve is opened by a signal from the defrosting condition detector, and a refrigerant path for feeding directly a part of a refrigerant from the compressor to the outdoor side heat exchanger, the refrigerant being returned to the compressor, is formed for a predetermined time.

Figure 17:
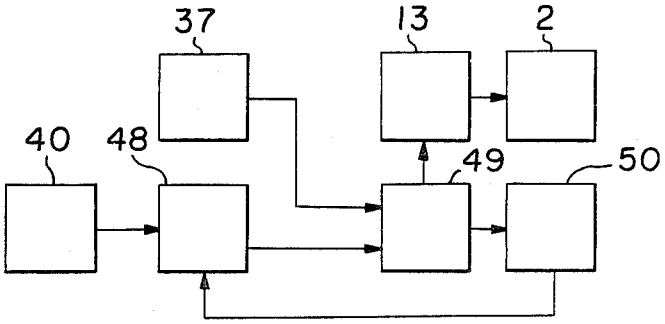
Figure 18:
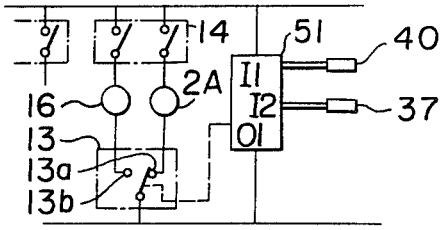
Figure 19:
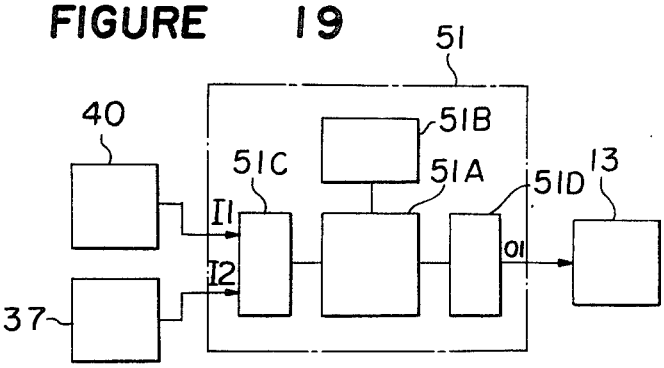
Figure 20:
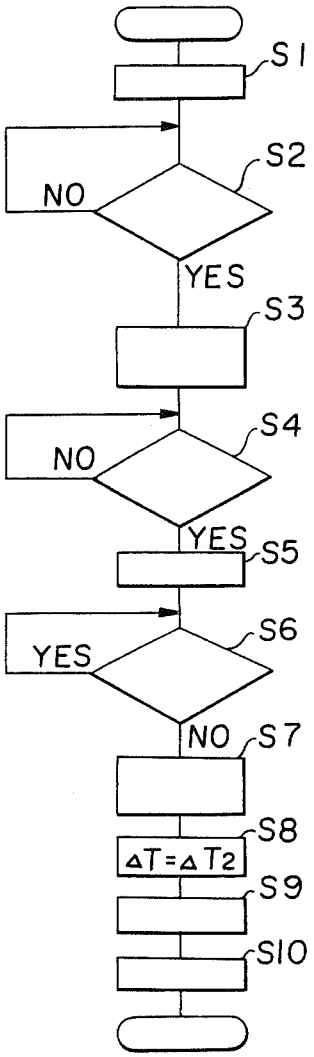
Figure 21:
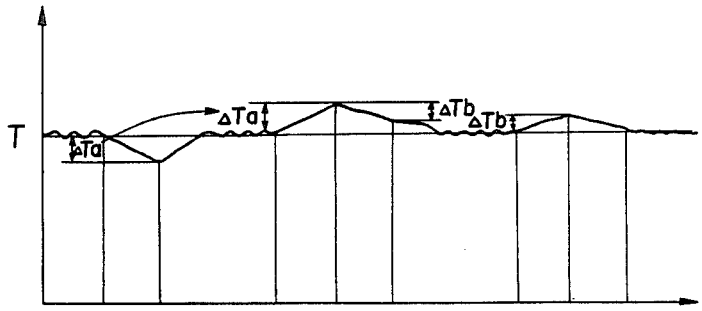
Figure 23:
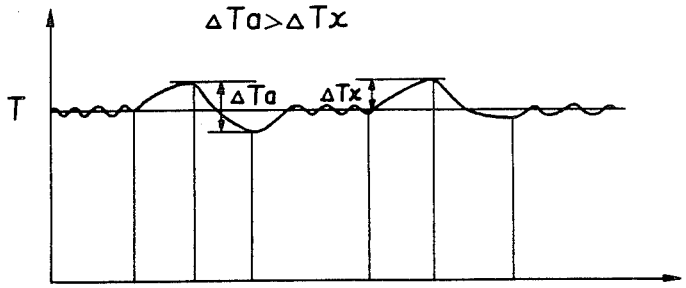
Figure 22:
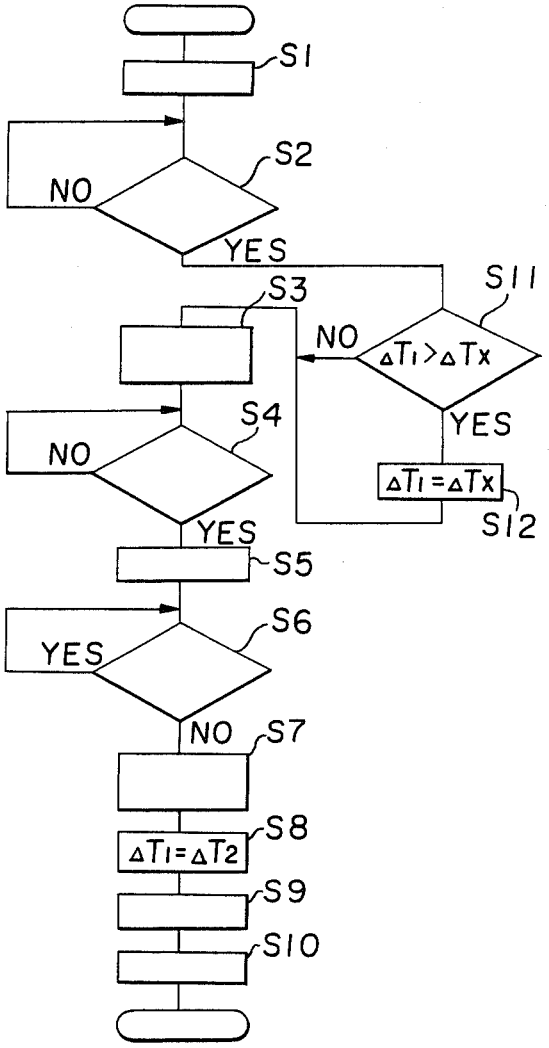
Figure 24:
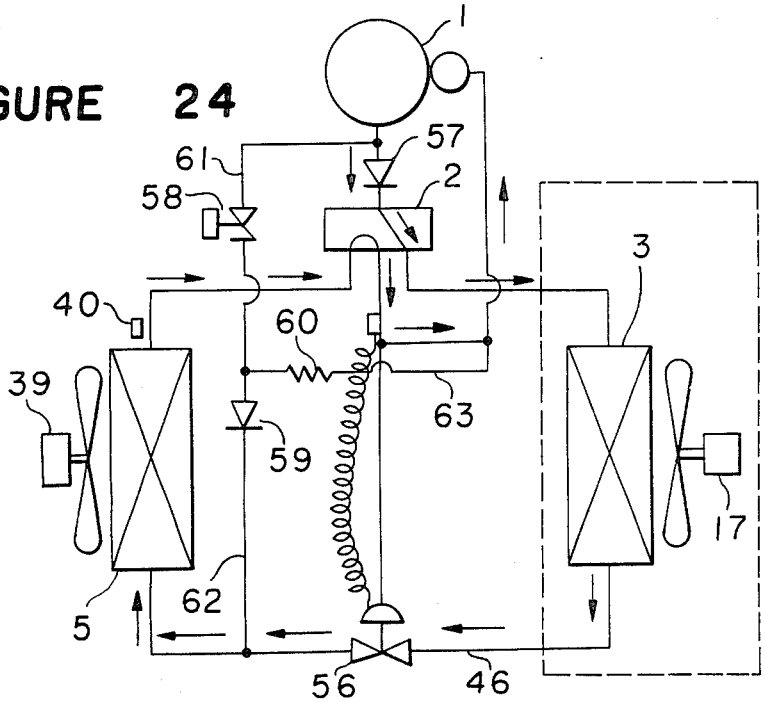
Figure 25:
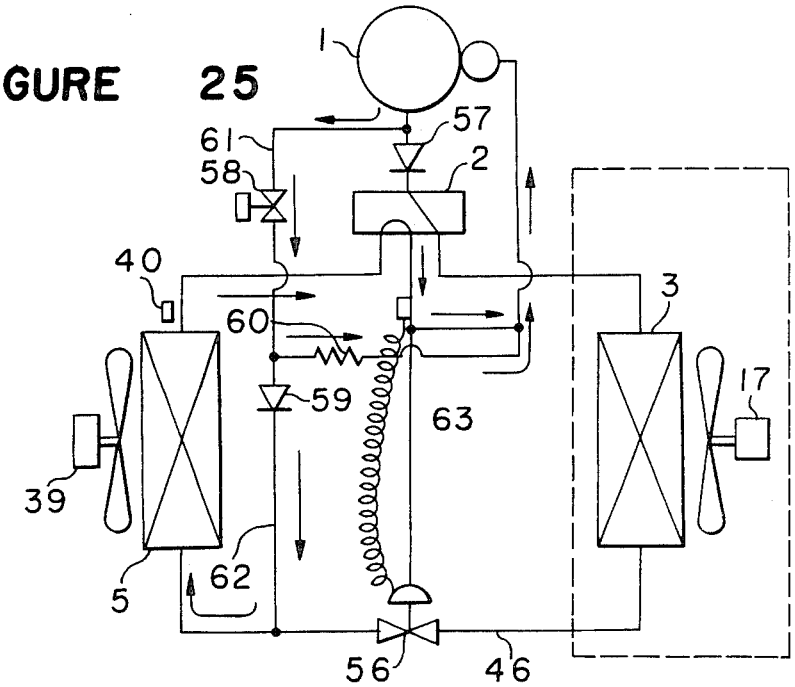
Figure 26:
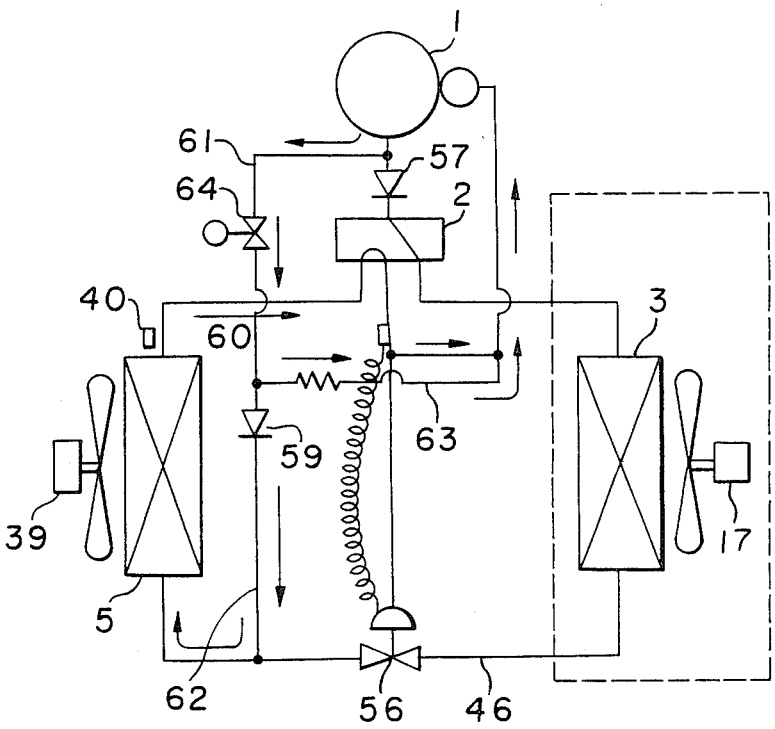
Figure 27:
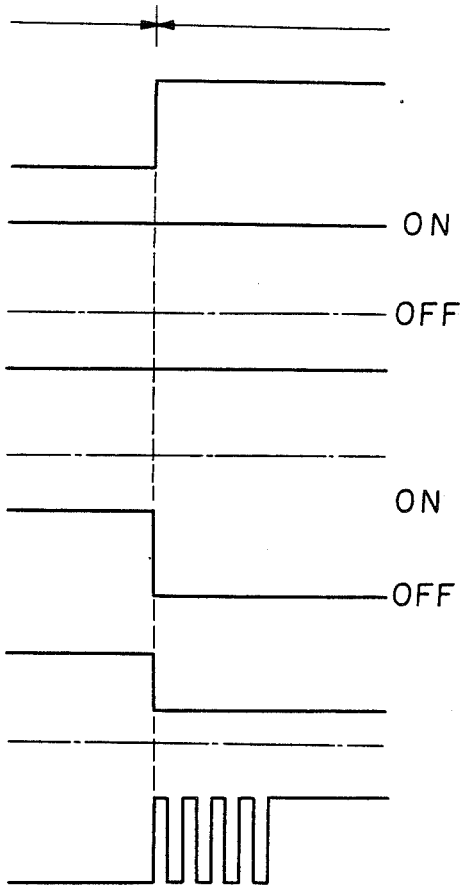
Figure 28:
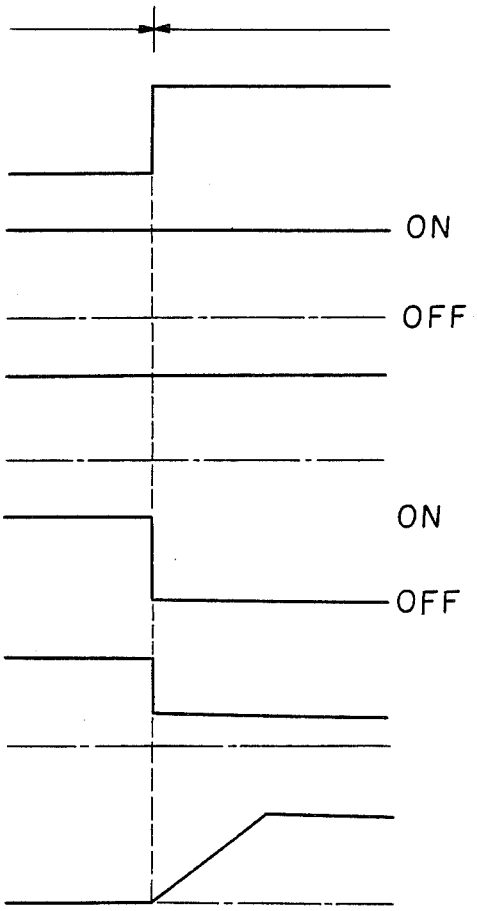
Figure 29:
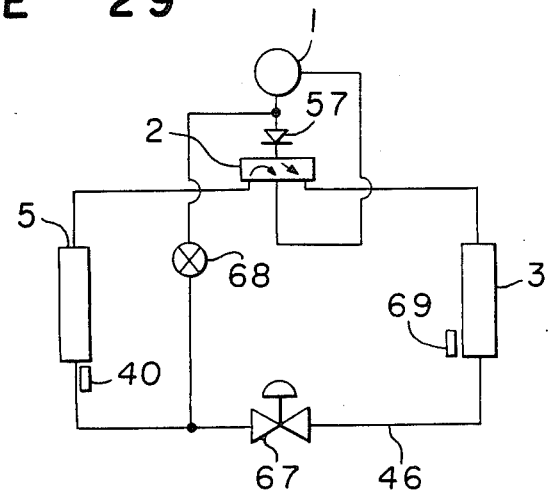
Figure 30:
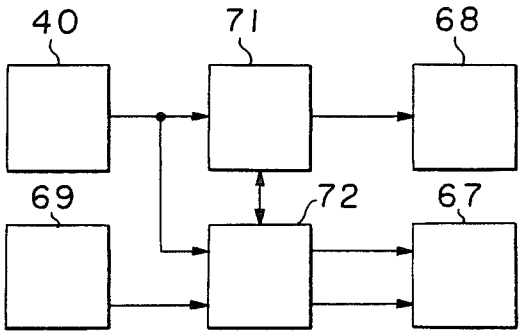
Figure 31:
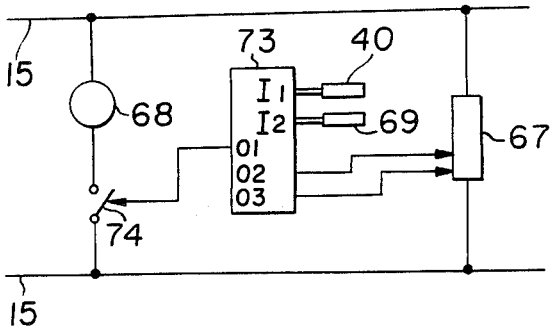
Figure 32:
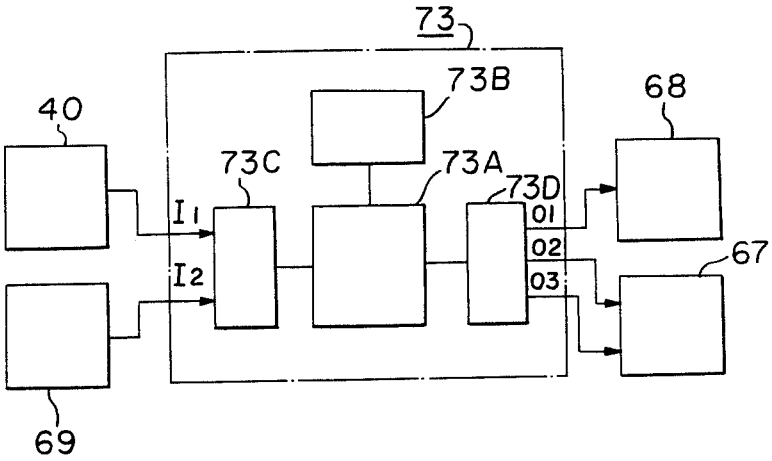
Figure 33:
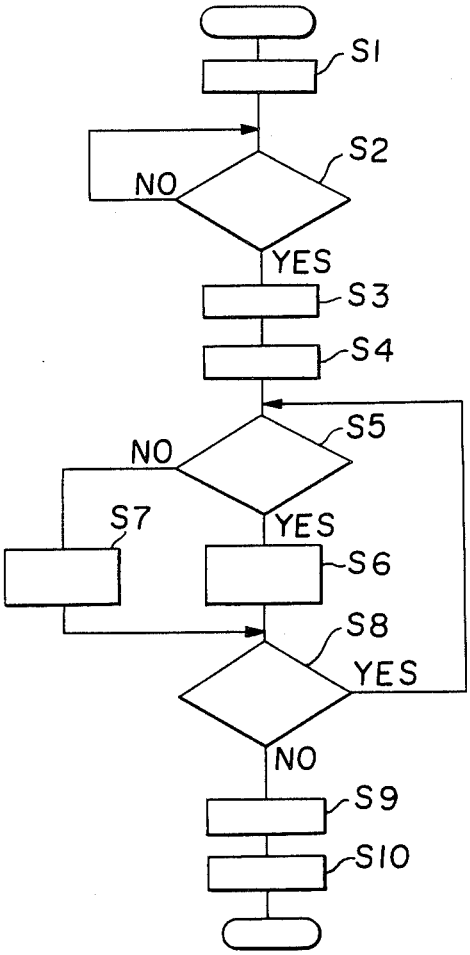
Figure 34:
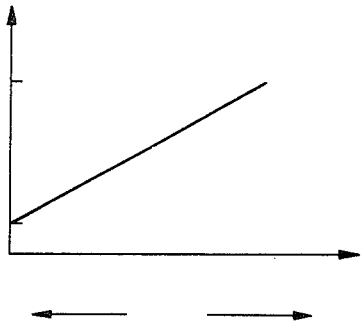
Figure 35:
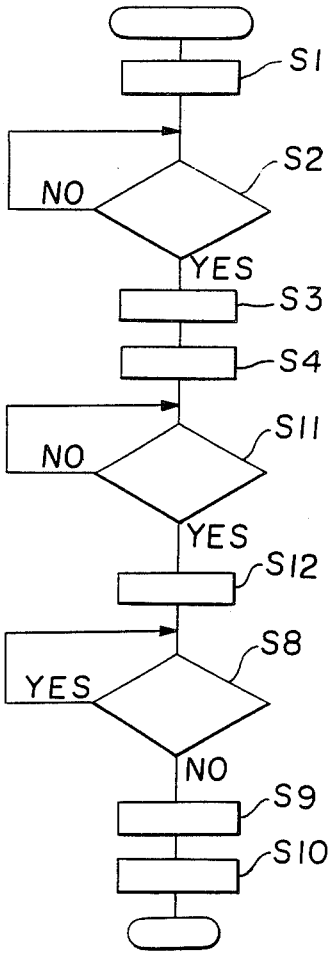

FIGS. 17 to 21 show a fourth embodiment of the air conditioning apparatus according to the present invention, in which FIG. 17 is a block diagram; FIG. 18 is an electric circuit of the controlling device in the defrosting operation; FIG. 19 is a block diagram of the controlling device shown in FIG. 18; FIG. 20 is a flow chart showing the operation of the controlling device shown in FIG. 19 and FIG. 21 is a diagram showing a relation between room temperature and time of the fourth embodiment;

FIGS. 22 and 23 show diagrams of a modified embodiment of the fourth embodiment, in which FIG. 22 is a flow chart showing the operation and FIG. 23 is a diagram showing a relation between room temperature and time;

FIG. 24 is a diagram showing the refrigerant circuit according to the fifth embodiment of the present invention in which the circuit arrangement is in the room-warming operation;

FIG. 25 shows a refrigerant circuit similar to FIG. 24 in which the circuit arrangement is in the defrosting operation;

FIG. 26 is a diagram showing a refrigerant circuit in a modified form of the fifth embodiment;

FIG. 27 is a time chart showing the operation in the defrosting operation in the fifth embodiment;

FIG. 28 is a time chart showing the defrosting operation in a modified form of the fifth embodiment;

FIGS. 29 to 34 show the sixth embodiment of the air conditioning apparatus according to the present invention, in which FIG. 29 shows a refrigerant circuit; FIG. 30 is a block diagram; FIG. 31 is an electric circuit; FIG. 32 is a block diagram of the controlling device shown in FIG. 31; FIG. 33 is a flow chart showing the operation of the air conditioning apparatus shown in FIG. 32 and FIG. 34 is a diagram showing the operation of electric type expansion valve shown in FIG. 29; and FIG. 35 is a flow chart showing the modified embodiment of the fifth embodiment.

In the following, preferred embodiments of the air conditioning apparatus of the present invention will be described with reference to drawings.

Figure 3:
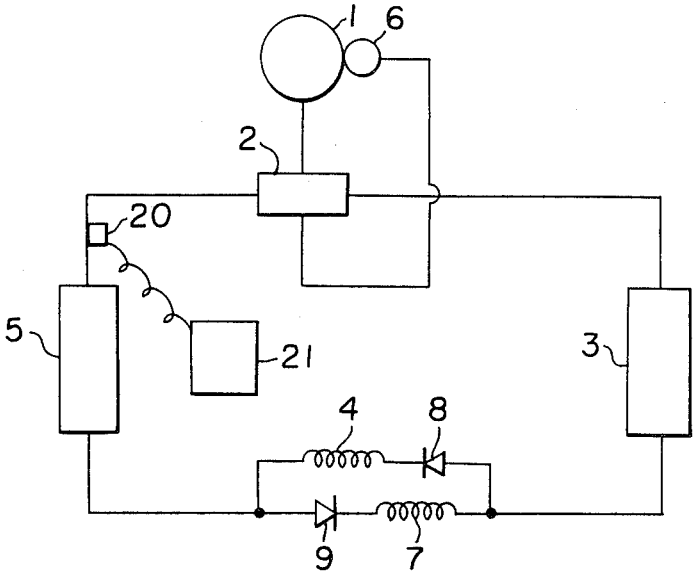
FIG. 3 is a diagram of a first embodiment of the refrigerant circuit for the air conditioning apparatus according to the present invention.

FIG. 3 shows the refrigerant circuit of a first embodiment of the present invention. In FIG. 3, the same reference numerals as in FIG. 1 designate the same or corresponding parts.

A reference numeral 1 designates a compressor, a numeral 2 designates a four-way valve, a numeral 3 designates a room side heat exchanger, a numeral 4 designates a capillary tube for room-warming, a numeral 5 designates an outdoor side heat exchanger, a numeral 6 designates an accumulator, a numeral 7 designates a capillary tube for cooling, numerals 8 and 9 designate check valves, a numeral 20 designates a temperature detector and a numeral 21 designates a controlling device connected to the temperature detector 20. The controlling device has a timer for integrating the time lapsed during the room-warming or the defrosting operation. The controlling device further determines a defrost prohibiting time $t_{DS}$, a defrost initiating temperature $T_s$ and a defrost ending temperature $T_E$, and outputs a signal to change operations from the defrosting operation to the room-warming operation and vice versa.

Figure 1:
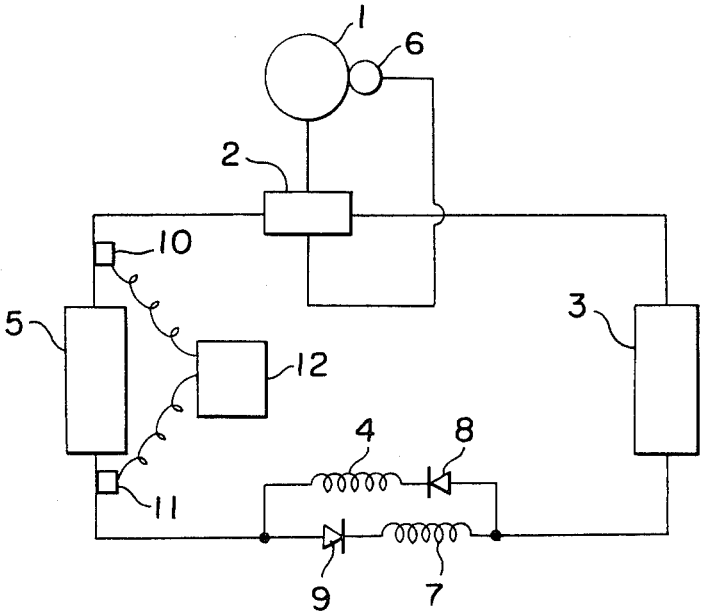
FIGURE 1 PRIOR ART
FIG. 1 is a diagram showing a refrigerant circuit of a conventional air conditioning apparatus.

As apparent from FIG. 3 in comparison with FIG. 1, the second temperature detector 11 is omitted from FIG. 1. However, the function of the controlling device 21 is fundamentally different from that in FIG. 1.

Figure 4:
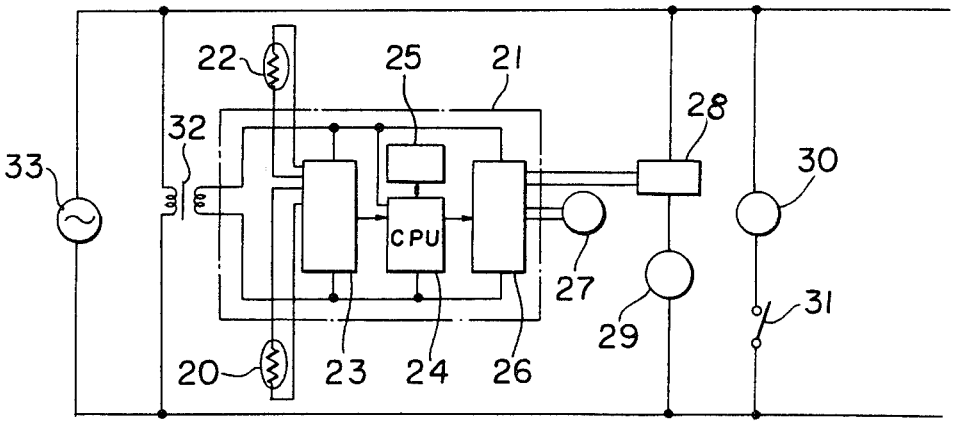
FIG. 4 is a diagram showing an electric circuit of a controlling device and parts associated therewith in the air conditioning apparatus shown in FIG. 3.

FIG. 4 shows the construction of the controlling device 21 in detail. FIG. 4 is a diagram of the electric circuit of the controlling device 21 and parts related thereto. The controlling device 21 consists of a microcomputer which includes an input circuit 23 and a CPU 24. The input circuit 23 receives signals from the temperature detector 20 and a room temperature detector 22 and outputs a signal to the CPU 24.

The controlling device 21 is also provided with a timer 25 which passes and receives data to and from the CPU 24. The output of the CPU 24 is supplied to a relay coil 27 and a semiconductor relay 28 through an output circuit 26.

The relay coil 27 has a contact 31. The contact 31 and an electromagnetic valve 30 are serially connected between the both polarities of a power source 33. The electromagnetic valve 30 is adapted to be excited or deenergized by opening and closing operations of the contact 31 depending on actuation and deenergization of the relay coil 27.

A serial connection of the semiconductor relay 28 and a fan 29 for the room side heat exchanger is connected across the both polarities of the power source 33. When the semiconductor relay 28 receives a signal from the output circuit 26, a conduction rate to the fan 29 is changed to thereby change the revolution of the fan 29.

The primary coil of a transformer 32 is connected between the opposite polarities of the power source 33 to apply a voltage to each part of the controlling device 21.

Figure 5:
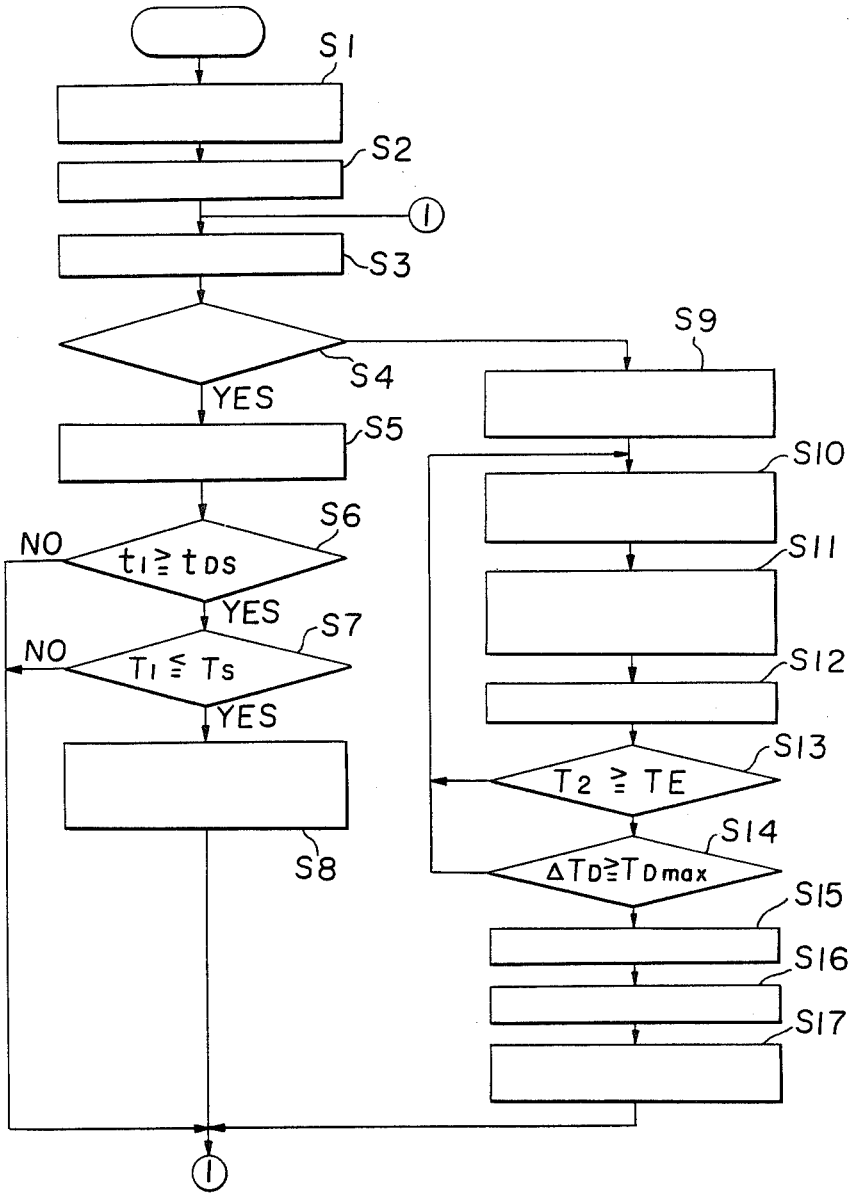
FIG. 5 is a flow chart showing the operation of the controlling device shown in FIG. 4.

FIG. 5 is a flow chart showing the operation of the controlling device 21 in which $T_S$ represents a defrost initiating temperature; $T_E$ represents a defrost ending temperature; $t_{DS}$ represents a defrost prohibiting time; $T_{Dmax}$ represents the maximum defrosting time; $T_{S1}$ represents a room temperature at the time of starting the defrosting operation; $T_{S2}$ represents a room temperature Ta minutes after the defrosting has started; $\Delta T_{R1}(=T_{S2}-T_{S1})$ represents change in the room temperature caused in the Ta minutes; $T_1$, $T_2$ represent temperatures of pipe lines detected by the temperature detector 20; $t_1$ represents time lapsed during the room-warming operation; Ta represents a time from initiation of the defrosting operation to detection of the room temperature; $\Delta T_D$ represents a defrosting time and $\Delta T_R$ represents allowable change in the room temperature which is originally set.

When the power source is turned on, the controlling device 21 determines values $T_S$, $T_E$, $T_{Dmax}$, $T_a$, $T_R$ and so forth which are to be initially set at Step S1. At Step S2, a defrost prohibiting time $T_{DS1}$ is preliminarily determined. In the subsequent Steps, the defrost prohibiting time $T_{DS}$ becomes variable.

Then, the temperature $T_1$ of the pipe line near the outdoor side heat exchanger 5 is detected by the temperature detector 20 provided on the pipe line connected to the outdoor side heat exchanger 5 at its inlet side during the room-warming operation (Step S3).

When the room-warming operation is established (Step 4), the time $t_1$ laped during the room-warming operation is integrated at Step S5 and the integrated time $t_1$ is compared with the initially set defrost prohibiting time $T_{DS}$ at Step S6. On the other hand, the temperature $T_1$ of the pipe line is compared with the defrost initiating temperature $T_S$ at Step S7. When $t_1 \geqq t_{DS1}$ and $T_1 \leqq T_S$, a signal for changing to the defrosting operation is output, and at the same time, the time $t_1$ is cleared (Step S8). The room-warming operation is continued when the above-mentioned conditions have not been established.

On the other hand, when the defrosting operation is carried out (Step S9), the room temperature $T_{S1}$ at the time of initiating defrosting operation is detected, and the defrosting time $\Delta t_D$ is integrated at Step S10. Then, the room temperature $T_{S2}$ $T_a$ minutes after the initiation of the defrosting operation is detected at Step S11. The temperature $T_2$ of the pipe line is detected at Step S12. The temperature $T_2$ of the pipe line is compared with the defrost ending temperature $T_E$ at Step S13. If $T_2 \geqq T_E$, the defrosting time $\Delta T_D$ is compared with the maximum defrosting time $T_{Dmax}$ at Step S14. Then, if $\Delta T_D > T_{Dmax}$, a value of change in the room temperature $\Delta T_{R1}(=T_{S2}-T_{S1})$ is calculated at Step S15. The thus obtained value of change in the room temperature $\Delta T_{R1}$ is compared with the initially determined allowable change in the room temperature $\Delta T_R$. When $\Delta T_{R1} > \Delta T_R$, the defrost prohibiting time $T_{DS}$ to be used in the subsequent steps is determined to be shorter than original defrost prohibiting time $T_{DS1}$ (Step S16). In this case, for instance, a relation of $T_{DS}=T_{DS1}-\alpha$ is established where $\alpha$ is time for calibration which can be arbitrarily determined.

Further, the following are determined;

When $\Delta T_{R1}=\Delta T_R$, then $T_{DS}=T_{DS1}$ and, when $\Delta T_{R1}<\Delta T_R$, then $T_{DS}=T_{DS1}+\alpha$.

When a room-warming changing signal is output, the defrosting time is cleared (Step S17).

Thus, the degree of reduction in the room temperature is calculated on the basis of the room temperature at the defrost initiating time and the room temperature $T_a$ minutes after the defrosting operation has initiated, and the defrost prohibiting time to be used for the subsequent steps is determined depending on the degree of reduction in the room temperature.

Figure 6:
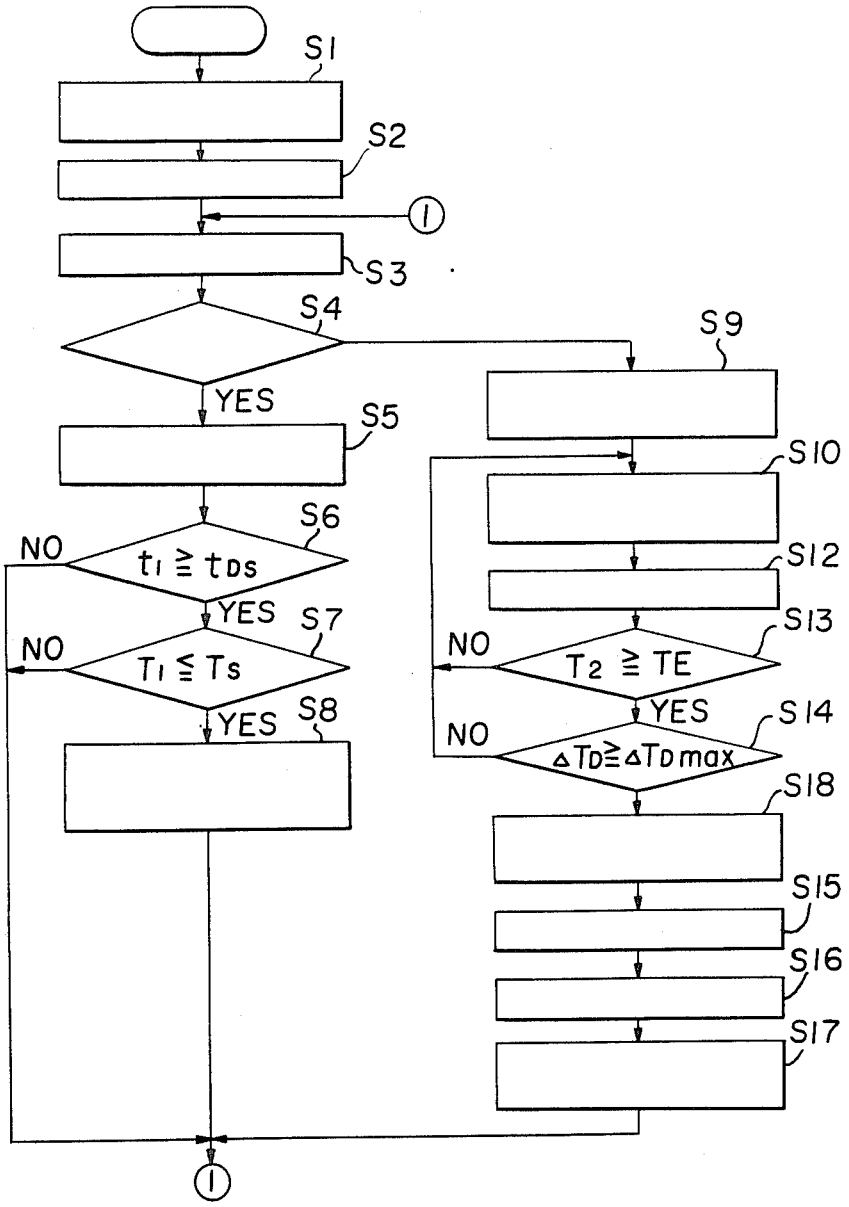
FIG. 6 is a flow chart showing the operation of a controlling device in a modified form of the controlling device shown in FIG. 5.

In the above-mentioned embodiment, change in the room temperature is determined by the value of difference between the room temperature $T_{S1}$ at the defrost initiating time and the room temperature $T_{S2}$ at the time when Ta minutes has lapsed from the initiation of the defrosting. However, a modification as shown in FIG. 6 is available. Namely, Step S11 in FIG. 5 is eliminated, and Step S18 is inserted between Steps S14 and S15. In this case, the same effect can be obtained by detecting the room temperature $T_{S3}$ at the time of ending the defrosting operation and by determining the differential between the room temperature $T_{S1}$ at the defrost initiating time and the room temperature $T_{S3}$ at the defrost ending time at Step 15.

When $t_1 \geqq t_{DS}$ and $T_1 \leqq T_S$, the defrosting operation is started. In this case, the room temperature $T_{S1}$ at the defrost initiating time is detected at Step S1, and the defrosting time $\Delta T_D$ is integrated at Step S10. Then, the pipe line temperature $T_2$ is detected at Step S12. The pipe line temperature $T_2$ is compared with the defrost ending temperature $T_E$ at Step S13, and the integrated time $\Delta T_D$ is compared with the maximum defrosting time $T_{Dmax}$ at Step S14. Then, when $T_2 \geqq T_E$ or $\Delta T_D \geqq T_{Dmax}$, the defrosting operation is finished.

The room temperature $T_{S3}$ under the above-mentioned condition is detected at Step S18. On the basis of thus obtained room temperature $T_{S3}$, change in the room temperature $\Delta T_R(=T_{S3}-T_{S1})$ is calculated at Step 15. The value of change in the room temperature is used to determine the defrost prohibiting time in the subsequent steps (Step S16).

In accordance with the first embodiment of the present invention, the defrosting operation is started at the optimum timing and unnecessary defrosting operation is prevented. Accordingly, the air conditioning apparatus can be operated at high efficiency, and comfortableness in a room can be obtained.

In the following, a second embodiment of the present invention will be described with reference to FIG. 7.

Figure 2:
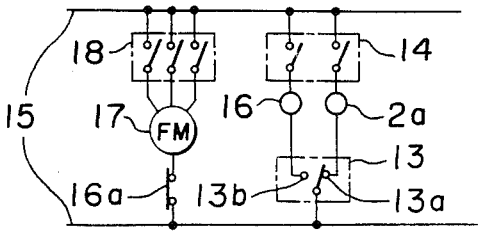
FIGURE 2 PRIOR ART
FIG. 2 is an electric circuit in a defrosting operation of the conventional air conditioning apparatus.
Figure 7:
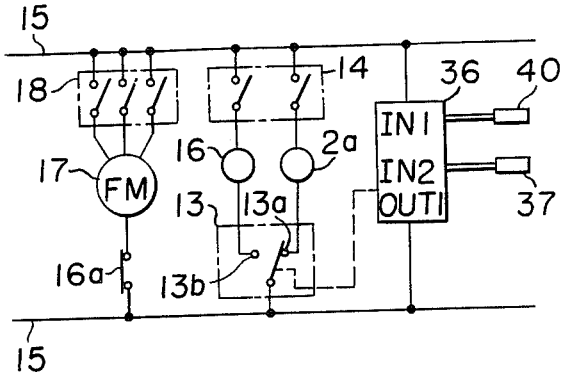
FIG. 7 is an electric circuit in the defrosting operation of a second embodiment of the controlling device of the air conditioning apparatus according to the present invention.

In FIG. 7, the same reference numerals as in FIG. 2 designate the same or corresponding parts.

The air conditioning apparatus shown in FIG. 7 is featurized by providing a defrosting controlling device 36 and a room temperature detector 37.

The defrosting controlling device 36 is provided with input terminals IN1, IN2 and an output terminal OUT1. The input terminal IN1 receives a detecting signal from the defrosting condition detector 40 and the input terminal IN2 receives a detecting signal from the room temperature detector 37.

The defrosting condition detector 40 is placed on a pipe line at the inlet side of the outdoor side heat exchanger in the room-warming operations, and the room temperature detector 37 is placed in a room.

The defrosting controlling device 36 generally comprises a micro-computer which includes a program ROM, a data RAM, an ALU (operating unit). The output terminal OUT1 of the defrosting controlling device 36 is adapted to change over the switching contact 13. Namely, the defrosting controlling device 36 reads the detecting signal input from the input terminals IN1, IN2 and sends the signal to the switching contact 13 from the output terminal OUT1 to perform the defrosting operation.

The operation of the second embodiment will be described with reference to the flow chart of FIG. 8 and the diagram of FIG. 9.

Figure 9:
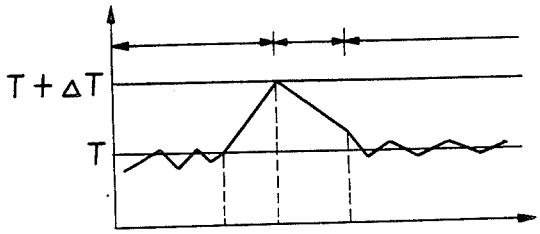
FIG. 9 is a diagram showing a relation between room temperature and time for the air conditioning apparatus according to the second embodiment of the present invention.
Figure 8:
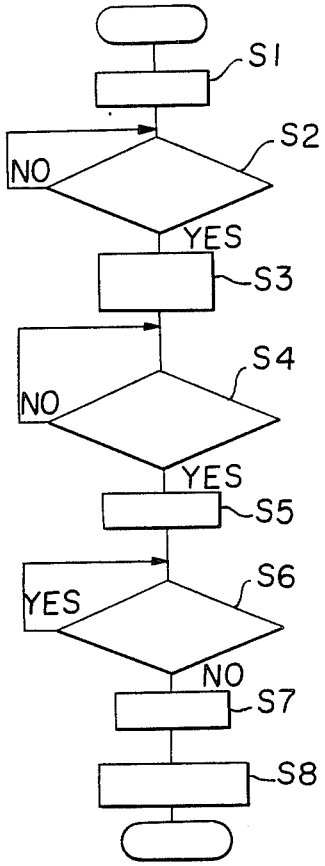
FIG. 8 is a flow chart showing the operation of the controlling device shown in FIG. 7.

FIG. 8 is a flow chart showing the defrosting controlling device 36 actuated by the output signal of the defrosting condition detector 40, and FIG. 9 is a diagram showing a relation between time and the room temperature during the defrosting operation.

In FIG. 8, it is assumed that the room-warming operation is carried out at Step 1. When the controlling device receives the detecting signal from the defrosting condition detector 40, then, the operation is shifted from Step S2 to Step S3 at which an instruction is given to the room temperature detector 37 to increase room temperature by $\Delta T$, while the room-warming operation is continued. When the room temperature detector 37 reaches the newly set room temperature $(T+\Delta T)$, then, the operation proceeds to Step S5 at which the defrosting operation is started.

On completion of the defrosting operation, which is detected by the defrosting condition detector 40, the operation proceeds from Step 6 to Step 7 at which the room-warming operation is restarted. The process of restarting the room-warming operation after completion of the defrosting is the same as that of the conventional apparatus.

At Step 7, the originally determined room temperature T is given to the room temperature detector 37 whereby the air conditioning apparatus is returned to the room-warming operation under the original condition.

The function of the air conditioning apparatus will be described with reference to FIG. 9.

FIG. 9 shows that the room temperature becomes $(T=\Delta T)$ due the increment of $\Delta T$ just before initiation of the defrosting operation, and the room temperature does not reduce to lower than the original room temperature T just after the completion of the defrosting operation. The increment of temperature $\Delta T$ may be determined depending on the load in the room.

In the second embodiment, the room temperature is increased to $(T+\Delta T)$ just before the initiation of the defrosting operation. However, the same effect can be obtained by starting the defrosting operation when a certain time ΔS has lapsed after increase of the set room temperature.

Figure 11:
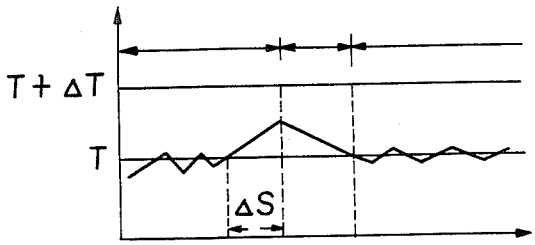
FIG. 11 is a diagram showing a relation between room temperature and time for the modified embodiment shown in FIG. 10.
Figure 10:
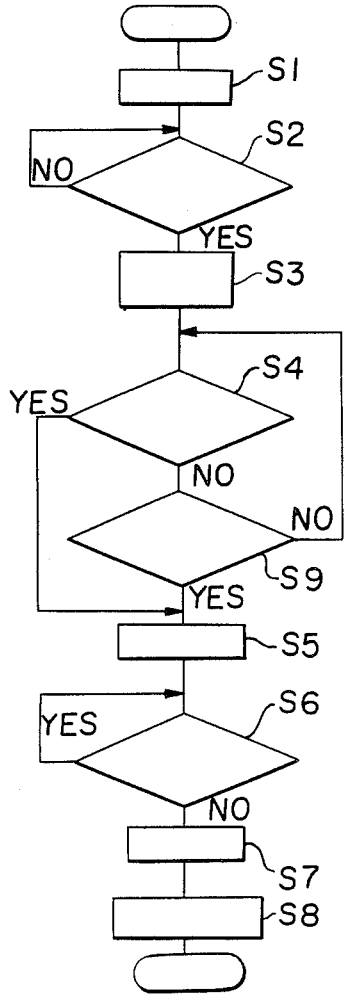
FIG. 10 is a flow chart showing the operation of the air conditioning apparatus in a modified form of the flow chart as in FIG. 8.

FIG. 11 is a diagram showing a relation of change in time to the room temperature and FIG. 10 is a flow chart showing the operation in the above-mentioned case. In FIG. 10, a series of Steps S4, S9 and S5 are established to initiate the defrosting operation even though the room temperature does not reach the set room temperature (T+ΔT).

The time ΔS may be determined in consideration that the capacity of room-warming is greately reduced by deposition of a large amount of frost in the outdoor side heat exchanger 5.

In accordance with the second embodiment of the present invention, the defrosting controlling device increases a set room temperature increase before initiation of the defrosting operation. Accordingly, reduction in the room temperature during the defrosting operation can be prevented and comfortable temperature in a living space can be maintained by a simple structure.

Figure 12:
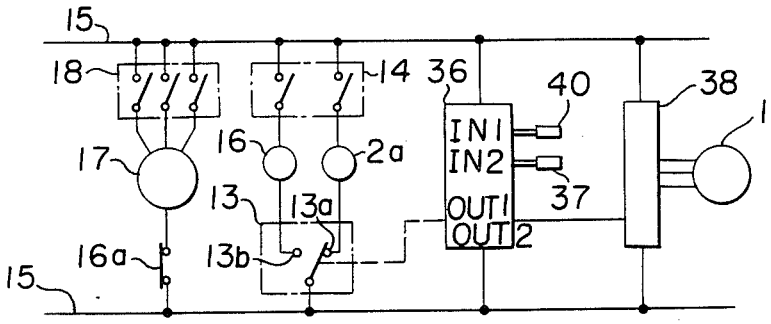
FIG. 12 is an electric circuit of the controlling device in the defrosting operation according to a third embodiment of the present invention.

FIG. 12 is a circuit diagram showing a third embodiment of the air conditioning apparatus of the present invention.

In FIG. 12, the same reference numerals as in FIG. 7 designate the same or corresponding parts, and therefore, description of these parts is omitted.

The structure of the third embodiment is the same as that in FIG. 7 except that a waveform regulating part 38 is provided.

The defrosting controlling device 36 consisting of a micro-computer is provided with input terminals IN1, IN2 and output terminals OUT1, OUT2 and includes a program ROM, a data RAM and ALU (operating unit). The input terminal IN1 receives a detecting signal from the defrosting condition detector 40. On the other hand, the input terminal IN2 receives a detecting signal from the room temperature detector 37.

The defrosting controlling device 36 reads the detecting signals received at the input terminals IN1, IN2 and outputs from the output terminals OUT1 an output signal so that the changing switch 13 is operated to start the defrosting operation. The controlling device 36 also outputs from the output terminal OUT2 an output signal to the waveform regulating part 38.

The waveform regulating part 38 is connected between the terminals 15 for the power source and controls the revolution of the compressor 1 depending on the output signal from the output terminal OUT2. The waveform regulating part 38 generally constitutes a device for driving an induction motor.

The operation of the third embodiment will be described with reference to FIGS. 13 and 14.

Figure 13:
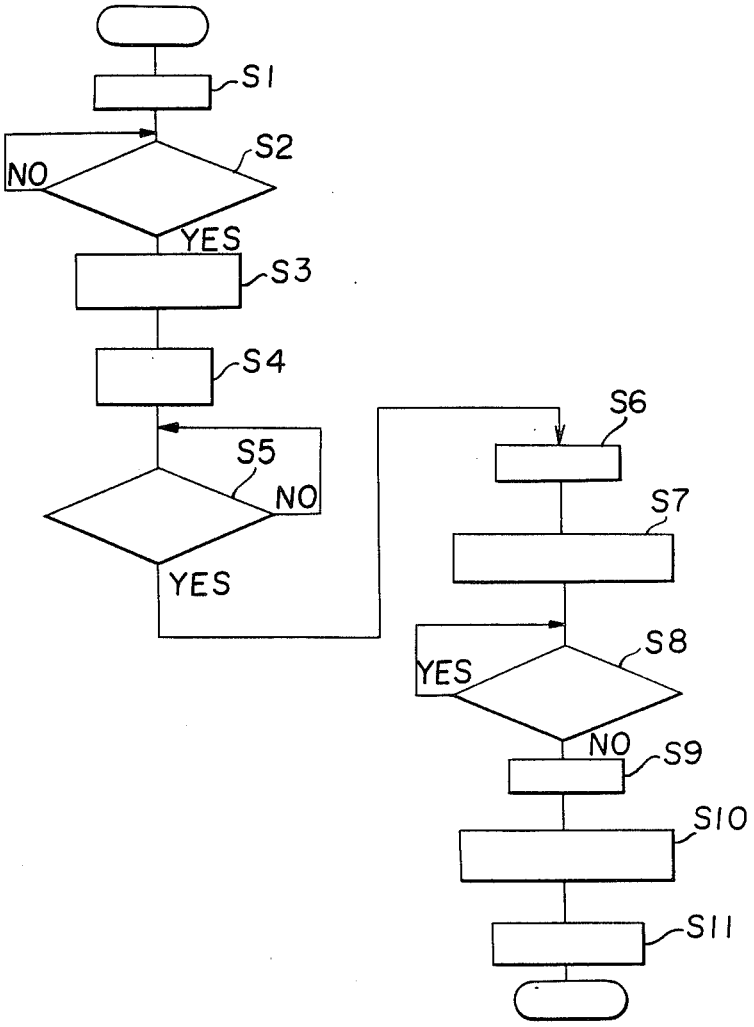
FIG. 13 is a flow chart showing the operation of the air conditioning apparatus provided with the controlling device shown in FIG. 12.
Figure 14:
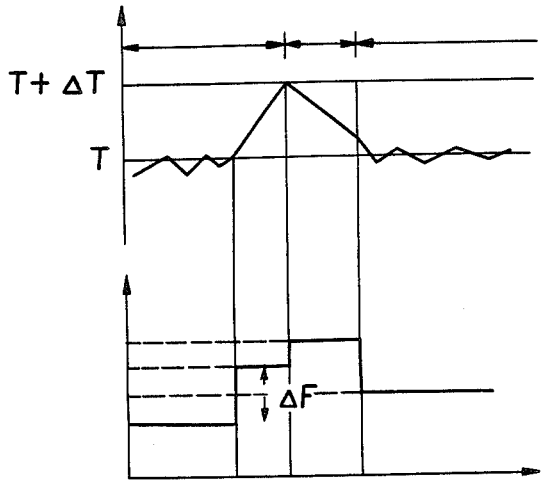
FIG. 14 is a diagram showing a relation between room temperature and time of the air conditioning apparatus shown in FIGS. 12 and 13.

In FIG. 13, when a detecting signal from the defrosting condition detector 40 is input to the input terminal IN1 during the room-warming operation (Step S1), determination is made as to whether or not conditions are suitable for starting the defrosting operation at Step S2. If the conditions are affirmative, the revolution of the compressor 1 is increased by ΔF (Step S3) as shown in FIG. 14. At Step S4, an instruction is given to the room temperature detector 37 to increase a set room temperature by ΔT, while the room-warming operation is continued. When the room temperature detector 37 detects the newly set room temperature (T+ΔT), then, Step S6 is performed to start the defrosting operation. The defrosting operation is carried out with the revolution F2 of the compressor 1 which has particularly been determined (Step S7).

When the defrosting condition detector 40 detects a temperature indicative of completion of the defrosting operation and outputs a detecting signal to the input terminal IN1 of the controlling device 36, then Step S9 is performed to return to the room-warming operation. At Step S10, the revolution of the compressor 1 is determined to be F3 (FIG. 14) which can be arbitrarity determined in the room-warming operation, and then, instruction is given to the room temperature detector 37 to have the originally set room temperature T; thus the condition is returned to the original room-warming operation (Step S11).

Just before the initiation of the defrosting operation, the revolution of the compressor 1 is increased by ΔF to be (F1+ΔF) and the temperature is increased by ΔT to be (T+ΔT). However, the room temperature does not decrease to a temperature lower than the original room temperature T even just after the completion of the defrosting operation. The increment of revolution ΔF of the compressor 1 and the increment of temperature ΔT of the room temperature detector 40 may be arbitrarily determined depending on the load in a room.

Figure 16:
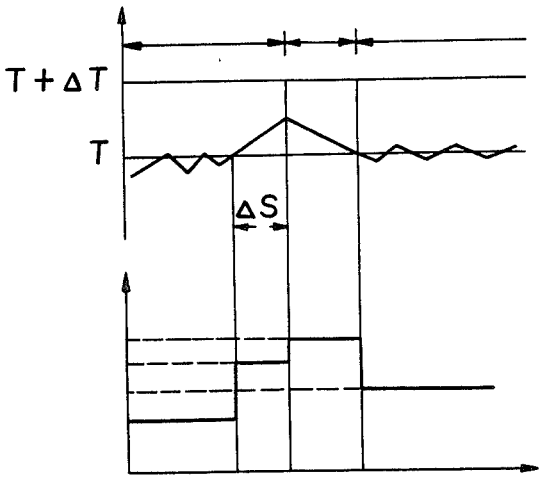
FIG. 16 is a diagram showing a relation between room temperature and time of the air conditioning apparatus shown in FIG. 15.

In the third embodiment, the revolution of the compressor 1 is increased to (F1+ΔF) just before the initiation of the defrosting operation and the room temperature is increased to (T+ΔT). However, the same effect can be obtained by starting the defrosting operation after the lapse of a certain time ΔS as shown in FIG. 16 showing a relation between the room temperature and time. The defrosting operation is started after the time ΔS has lapsed during which the revolution of the compressor 1 and the room temperature has been increased.

Figure 15:
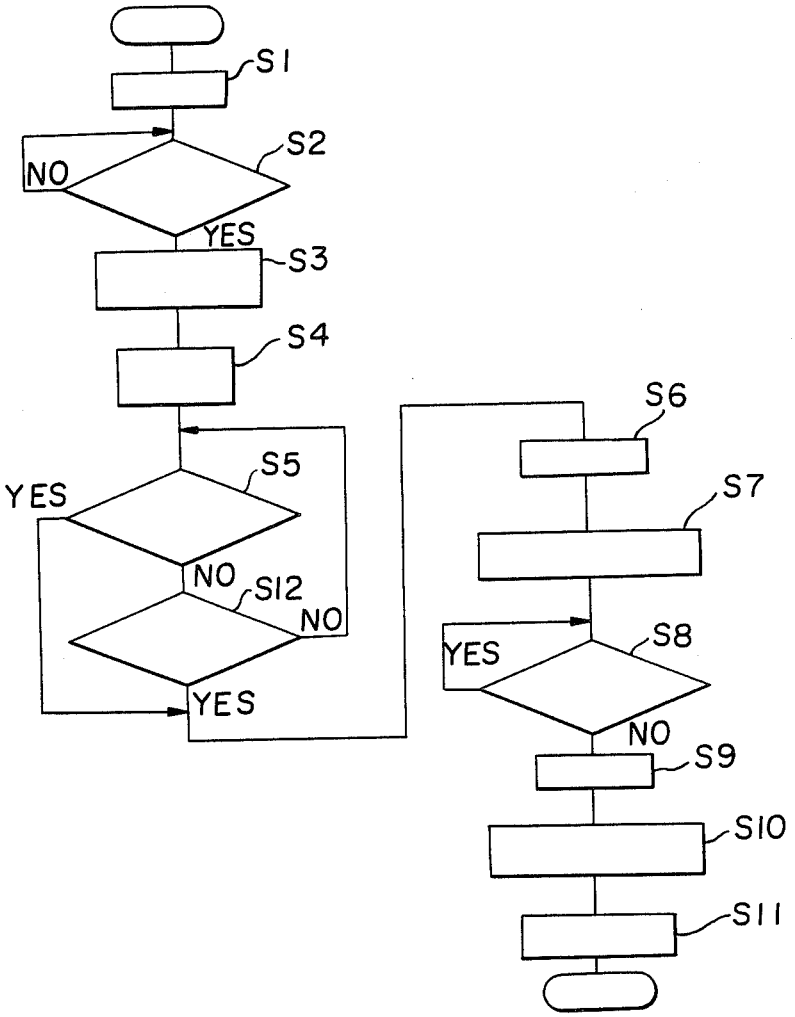
FIG. 15 is a flow chart showing the operation of the controlling device in a modified form of the third embodiment.

FIG. 15 is a flow chart for performing the operation as in FIG. 16. In FIG. 15, determination is made whether or not the room temperature has reached the set room temperature (T+ΔT) at Step S5. However, the defrosting operation is started at Step S6 due to the lapse of time ΔS (Step S12) even though the room temperature does not reach the set temperature (T+ΔT). The time ΔS is determined in consideration of the ability of the outdoor side heat exchanger which is largely affected by an amount of frost deposited in it.

In the third embodiment of the present invention, the revolution of the compressor is increased to increase the room temperature before the initiation of the defrosting operation, and when the room temperature reaches the set temperature, the defrosting operation is started. Accordingly, reduction in the room temperature during the defrosting operation is prevented and a comfortable temperature in the living space can be obtained. Further, the construction of the apparatus can be simple.

FIGS. 17, 18 and 19 show a fourth embodiment of the present invention. In the Figures, the same reference numerals as in FIG. 1, FIG. 7 and FIG. 12 designate the same or corresponding parts.

FIG. 17 is a diagram of the fourth embodiment. The fourth embodiment is so constructed that the defrosting condition detector 40 and the room temperature detector 37 are provided; when an output of the defrosting condition detector 40 is input to a set temperature increasing means 48, it lets a set temperature in the room temperature detector 37 increase; when a defrosting operation detector 49 detects that the room temperature detected by the room temperature detector 37 reaches the set temperature determined by the set temperature increasing means 48, it operates the four-way valve 2 through the changing switch 13 to perform the defrosting operation; a memory 50 for memorizing reduction of room temperature detects and memorizes the reduction in the room temperature during the defrosting operation, and the memory 50 outputs a signal to the set temperature increasing means 48 so that a newly set temperature is used for the subsequent steps.

FIGS. 18 and 19 are respectively a circuit diagram and a block diagram of the defrosting controlling device according to the fourth embodiment of the present invention.

In FIGS. 18 and 19, a reference numeral 51 designates defrosting controlling device comprising a micro-computer and includes a CPU 51A, a memory 51B, an input circuit 51C and an output circuit 51D. The defrosting condition detector 40 is connected to an input terminal I1, the room temperature detector 37 is connected to another input terminal I2 of the input circuit 51C, and the changing switch 13 is connected to an output terminal O1 of the output circuit 51D.

The operation of the fourth embodiment will be described with reference to FIGS. 20 and 21.

First of all, the room-warming operation is performed at Step S1. When the defrosting condition detector 40 detects establishment of a defrosting condition (Step 2), Step S3 is taken so that a set temperature is determined to be (T+ΔT1) for starting of the defrosting operation, while the room-warming operation is continued. The temperature ΔT1 is determined by a value of reduction in the room temperature which has been detected by the room temperature dectector 37 in the previous defrosting operation. ΔT1 is zero before initiation of the first defrosting operation when the air conditioning apparatus has been started. When the room temperature reaches (T+ΔT1), the defrosting operation detector 49 operates the changing switch 13 (Step 5) to start the defrosting operation.

During the defrosting operation, when the room temperature detector 37 detects that the defrosting condition should be released at Step 6, the defrosting condition is released, and thereafter, Step 7 is taken at which a value of reduction in the room temperature ΔT2 during the defrosting operation is detected by the room temperature detector 37. At Step S8, the value ΔT2 is memorized to be used as a value of an increment of the room temperature in the next defrosting operation. Thereafter, the room-warming operation is restarted at Step S9. At Step S10, the originally set temperature T is used and the original room-warming operation is carried out.

FIG. 21 is the diagram showing a relation between the room temperature and time in which the defrosting operations are repeatedly performed. Namely, a component $\Delta T_a$ which is an amount of reduction of the room temperature in the previous defrosting operation is added to the next defrosting operation, and a component $\Delta T_b$ which is an amount of reduction in the room temperature in that defrosting operation is added to the further next defrosting operation. Accordingly, the room temperature just after the completion of a certain defrosting operation becomes almost near the original room temperature T. Thus, temperature is detected for each defrosting operation and a reduced temperature is used for the subsequent defrosting operation depending on the load in a room.

FIGS. 22 and 23 are respectively a flow chart and a diagram showing a relation between room temperature and time in a modified form of the above-mentioned fourth embodiment.

In contrast with the fourth embodiment in which temperature reduction in a room is added for the subsequent defrosting operation, the modified embodiment is controlled such that an upper limit of ΔT1 is provided. Namely, in FIG. 22, determination is made whether or not the increment of the room temperature ΔT1 is larger than a component ΔTx of the upper limit of the room temperature at Step S11. If it is smaller than the upper limit temperature, then Step S3 is taken. On the other hand, if it is larger than the limit, a component of increased room temperature ΔT1 is changed to ΔTx for the next defrosting operation at Step S12. ΔTx is determined to be lower than the maximum room temperature of an air conditioning apparatus.

As described above, in the fourth embodiment of the present invention, the structure of the apparatus is made simple, while excessive reduction in the room temperature during the defrosting operation is prevented and the living space is kept in a comfortable condition.

FIGS. 24 and 25 show a fifth embodiment of the present invention. In this embodiment, reduction in the room temperature during the defrosting operation can be prevented and noise generated from the four-way valve when it is operated can be eliminated.

FIG. 24 is a diagram of the refrigerant circuit in the room-warming operation, and FIG. 25 when in the defrosting operation.

In the Figures, a reference numeral 1 designates a compressor, a numeral 2 a four-way valve, a numeral 3 a room side heat exchanger, a numeral 5 an outdoor side heat exchanger, a numeral 46 a pipe line for a refrigerant, a numeral 17 a fan for the room side heat exchanger, a numeral 39 a fan for the outdoor side heat exchanger and a numeral 40 a defrosting condition detector. A mechanical type expansion valve 56 is placed in the pipe line 46 between the room side heat exchanger 3 and the outdoor side heat exchanger 5. A first check valve 57 is interposed between the outlet side of the compressor 1 and the four-way valve 2. A numeral 58 designates an electromagnetic valve, a numeral 59 a second check valve and a numeral 60 a capillary tube. A first by-pass line 61 is connected at its one end to the refrigerant pipe between the outlet side of the compressor 1 and the first check valve 57, and the other end of the first by-pass line is connected to the second check valve 59. A second by-pass line 62 extends between the second check valve 59 and the refrigerant pipe 46 between the outdoor side heat exchanger and the mechanical type expansion valve 56. A third by-pass line 63 extends between the first by-pass line 61 between the electromagnetic valve 58 and the second check valve 59 and the refrigerant pipe 46 between the compressor 1 and the four-way valve 2. The first by-pass line 61 includes the electromagnetic valve 58, and the third by-pass line 63 includes the capillary tube 60.

The operation of the fifth embodiment will be described with reference to FIGS. 24, 25 and 27.

In the refrigerant circuit performing the room-warming operation in FIG. 24, a high temperature, high pressure refrigerant gas compressed in the compressor 1 is supplied through the first check valve 57 and the four-way valve 2 to the room side heat exchanger 3 where it is condensed while a room is warmed. The refrigerant liquid is then flown to the mechanical type expansion valve 56. The refrigerant is subjected to pressure-reduction in the expansion valve 56 and evaporates in the outdoor side heat exchanger 5. The refrigerant gas is then returned to the compressor 1 through the four-way valve 2. In this case, the refrigerant is not flown into the second and third by-pass lines 62, 63, since the electromagnetic valve 58 in the first by-pass line 61 is closed.

When atmospheric temperature decreases, the evaporation temperature for the refrigerant in the outdoor side heat exchanger 5 decreases to become a dew point temperature or lower, whereby deposition of frost in the outdoor side heat exchanger 5 begins. Accordingly, the temperature of the outdoor side heat changer 5 decreases. When the temperature decreases to a predetermined temperature or lower, the defrosting condition detector 40 detects the deposition of frost, and the defrosting operation is started. FIG. 27 shows a state of operation which is changed from the room-warming operation to the defrosting operation.

FIG. 25 shows the refrigerant circuit in the defrosting operation. In this case, the fan 39 for the outdoor side heat exchanger is stopped while the compressor 1 is continuously driven. On the other hand, the revolution of the fan 17 for the room side heat exchanger is lowered. At the same time, the electromagnetic valve 58 undergoes repeated opening and closing operations for a predetermined time and at fixed intervals, after which the valve is opened. The operation of the electromagnetic valve 58 relieves a sudden change of pressure when operation is switched from the room-warming operation to the defrosting operation, and allows the high temperature, high pressure refrigerant gas compressed in the compressor 1 to be sent to the second and third by-pass lines 62, 63 through the first by-pass line 61. The refrigerant forwarded in the second by-pass line 62 is directly supplied through the second check valve 59 to the outdoor side heat exchanger 5 to dissolve the frost while the refrigerant itself is condensed. The condensed refrigerant is mixed with the high temperature, high pressure refrigerant gas which is forwarded in the third by-pass line 63 through the capillary pipe 60. Then, the refrigerant becomes a saturated gas down stream of the four-way valve 2, and finally is sucked into the compressor 1. In this case, the expansion valve 56 is closed. Accordingly, in the refrigerant circuit extending from the check valve 57 through the room side heat exchanger 3 to the expansion valve 56, a high pressure condition in the room-warming operation is maintained. Accordingly, warm air can be supplied in the room even in the defrosting operation, by sending a gentle stream of air by the fan 17 for the room side heat exchanger 3.

As an alternative of the fifth embodiment, modification may be made in such a manner that a current limiting valve 64 is provided in the first by-pass line 61 instead of the electromagnetic valve 58. FIG. 28 is a time chart for the modified embodiment in which the current limiting valve 64 is provided.

When the room-warming operation is changed to the defrosting operation, the valve body of the current limiting valve 64 is gradually opened whereby the high temperature, high pressure refrigerant gas compressed in the compressor 1 is supplied to the second and third by-pass lines 62, 63 through the first by-pass line 61. In this case, the same effect as the fifth embodiment can be obtained.

Thus, in the fifth embodiment, a sudden change in pressure caused when the room-warming operation is switched to the defrosting operation is avoided, and noise and vibrations caused by the sudden pressure change can be reduced. At the same time, the defrosting operation can be performed for a short time and a cool refrigerant is not forwarded in the room side heat exchanger, whereby the room-warming operation can be restarted quickly after the completion of the defrosting operation. Further, the living space in the room can be kept in comfortable condition.

FIGS. 29 to 34 show the sixth embodiment of the present invention in which the same reference numerals designate the same or corresponding parts.

FIG. 29 is a diagram showing the refrigerant circuit of the sixth embodiment. In FIG. 29, a numeral 57 designates a check valve inserted between the outlet side of the compressor 1 and a four-way valve 2; a numeral 67 designates an electric type expansion valve in which the valve body (not shown) is controlled between the entirely closed condition and the entirely opened condition by receiving an input signal, a numeral 68 designates an electromagnetic valve connected between the outlet side of the compressor 1 and the inlet side of the outdoor side heat exchanger 5 in the room warming operation, and a numeral 69 designates a pipe temperature detector which is provided at a pipe line near the outdoor side heat exchanger 3 to detect its temperature. In FIG. 29, fans 17 and 39 as shown in FIG. 24 are omitted.

FIG. 30 is a block diagram showing the entire construction of the defrosting controlling device. As apparent from FIG. 30, the device comprises the defrosting condition detector 40, an electromagnetic valve operator 71 which receives an output from the defrosting condition detector 40 and outputs a signal to the electromagnetic valve 68 to control the same, an expansion valve controller 72 which receives the output of the defrosting condition detector 40 and the output of the pipe temperature detector 69 and outputs a signal to the electric type expansion valve 67 to control the degree of opening of the expansion valve 67.

FIGS. 31 and 32 are respectively an electric circuit of an important part of the air conditioning apparatus of the sixth embodiment and a block diagram of a defrosting controlling device.

In the Figures, a reference numeral 73 designates defrosting controlling device comprising a micro-computer which includes a CPU 73A, a memory 73B, an input circuit 73C and an output circuit 73D. The defrosting condition detector 40 is connected to an input terminal I1 of the input circuit 73C, and the pipe temperature detector 69 is connected to another input terminal I2. A driving device (not shown) for a contact 74 of the electromagnetic valve 68 is connected to the output terminal O1 of the output circuit 73D, the electric type expansion valve 67 is connected to output terminals O2, O3.

The operation of the sixth embodiment will be described with reference to FIGS. 33 and 34.

FIG. 33 is a flow chart showing an operating program stored in the memory 73B in the defrosting controlling device 73, and FIG. 34 is a diagram showing the operation of the electric type expansion valve 67.

While the room-warming operation is carried out (Step S1), the defrosting condition detector 40 observes whether the temperature at the outdoor side heat exchanger satisfies the defrosting condition (Step S2). When the defrosting condition is detected by the detector 40, then Step S3 is taken to generate an output from the output terminal O1 of the defrosting controlling device 73 to thereby open the electromagnetic valve 68 by making the contact 74. In the next step, an output is generated from the output terminal O3 at Step 4. The magnitude of the output is variable and the electromagnetic expansion valve 67 is driven so that the valve body is forced to be opened depending on the magnitude of the output as shown in FIG. 34. Opening of the electromagnetic valve 68 permits the high temperature refrigerant gas produced in the compressor 1 to enter into the outdoor side heat exchanger 5 through the electromagnetic valve 68 so as to melt the frost deposited on the heat exchanger. At the same time, the expansion valve 67 is entirely opened, and the high temperature refrigerant present in the room side heat exchanger 3 upon carrying out the room-warming operation is supplied into the outdoor side heat exchanger 5. The refrigerant from the room side heat exchanger 3 shortens the defrosting time.

During the defrosting operation, the high temperature refrigerant gas is usually supplied to the room side heat exchanger 3 so that room-warming function is obtainable. However, when the amount of the refrigerant flowing in the outdoor side heat exchanger 5 via expansion valve 67 increases, the temperature of the room side heat exchanger 3 decreases, and an occupant may feel a reduction in the room-warming function. To avoid this, the expedients in the Step S5 to Step S7 are incorporated. Namely, determination is made by the pipe temperature detector 69 as to whether or not the temperature of the room side heat exchanger 3 is lower than a predetermined temperature T which gives a feeling of coolness to the occupant (Step S5). When the temperature of the room side heat exchanger 3 is lower than the temperature T, an output signal is generated from the output terminal O2 of the controlling device 73 (Step S6). The output signal drives the electric type expansion valve 6 in the direction to close the valve body depending on the magnitude of the output as shown in FIG. 34. As a result, the amount of the refrigerant flowing from the room side heat exchanger 3 is decreased and the temperature of the room side heat exchanger 3 is increased whereby the feeling of warmness is increased.

When the temperature detected by the pipe temperature detector 69 is lower than the temperature T, Step S7 is taken to open the expansion valve 67 thereby shortening the defrosting time.

Then, determination as to whether or not the defrosting condition is released is made at Step S8. When the defrosting condition is released, the electromagnetic valve 68 is closed (Step S9) and thereafter the room-warming operation is restarted (Step S10).

In the above-mentioned explanation, the temperature T is a critical temperature at which an occupant feels the temperature reduction in the warming operation and corresponds to the temperature of blown air in the room-warming operation. The temperature T may be determined optionally.

FIG. 35 is a flow chart of a modified form of the sixth embodiment.

In this modified embodiment, the electric type expansion valve 67 is entirely opened for a predetermined time and thereafter it is entirely closed in contrast with the embodiment shown in FIG. 33 in which the degree of opening of the valve body of the expansion valve 67 is controlled depending on the output of the pipe temperature detector 69 during the defrosting operation. Namely, at Step S4 in FIG. 35, the electric type expansion valve 67 is entirely opened. At Step S11, time ΔS is counted. When the time ΔS has lapsed, the expansion valve 67 is entirely closed at Step S12. The process in FIG. 35 is the same as those in FIG. 33 except for the above-mentioned differences. The time ΔS may be determined based on the time in which the occupant feels shortage of warming from the temperature of the room side heat exchanger 3 after the expansion valve 67 has been entirely opened.

The modified embodiment provides the same function as the sixth embodiment. Further, it is unnecessary to use the pipe temperature detector 69, which simplifies the air conditioning apparatus.

We claim:

1. An air conditioning apparatus comprising a refrigerant circuit in which a compressor is connected to a four-way valve, and the four-way valve is connected by pipe lines in a circuit including a room side heat exchanger, a pressure-reducing device and an outdoor side heat exchanger connected in that order, further comprising:

a refrigerant temperature detector provided at a pipe line near said outdoor side heat exchanger, a room temperature detector for detecting temperature of a room, and a controlling device which is electrically connected to said refrigerant temperature detector and said room temperature detector and which controls operations for room-warming and defrosting of the outdoor side heat exchanger based on inputs from said detectors;

wherein said controlling device includes a timer and outputs a signal to change the room-warming operation to the defrosting operation and vice versa and compares a room temperature at the time of starting the defrosting operation with a room temperature at a predetermined time after the start of the defrosting operation to detect a value of reduction in the room temperature thereby to determine a defrost prohibiting time which is maximum amount of time during which defrosting of the outside heat exchanger is to occur;

wherein said controlling device varies the defrosting prohibiting time based on a value of reduction in room temperature between a defrosting initiation time and defrosting ending time.

2. The air conditioning apparatus according to claim 1, wherein said refrigerant temperature detector detects a temperature at which the defrosting operation is started, and said controlling device raises temperature to be set in said room temperature detector when said controlling device receives a signal from said refrigerant temperature detector.

3. The air conditioning apparatus according to claim 2, wherein said controlling device starts a defrosting operation a predetermined time after said room temperature has been raised.

4. The air conditioning apparatus according to claim 1, wherein said refrigerant temperature detector detects a temperature at which the defrosting operation is started, and said controlling device increases the revolution of said compressor before starting the defrosting operation and raises temperature to be set in said room temperature detector when a signal from said refrigerant temperature detector is input into said controlling device.

5. The air conditioning apparatus according to claim 4, wherein said controlling device starts the defrosting operation after the decision that the revolution of said compressor is increased and the setting room temperature is raised, has been made and a certain time has lapsed from the decision.

6. An air conditioning apparatus comprising a refrigerant circuit in which a compressor is connected to a four-way valve, and the four-way valve is connected by pipe lines in a circuit including a room side heat exchanger, a pressure-reducing device and an outdoor side heat exchanger connected in that order, further comprising:

a refrigerant temperature detector provided at a pipe line near said outdoor side heat exchanger, a room temperature detector for detecting temperature of a room, and a controlling device which is electrically connected to said refrigernat temperature detector and said room temperature detector and which controls operations for room-warming and defrosting of the outdoor said heat exchanger based on inputs from said detectors;

wherein said refrigerant temperature detector detects a temperature at which the defrosting operation is started, and wherein said controlling device comprises a defrosting means for starting the defrosting operation by actuating said four-way valve, a temperature increasing means for increasing a prdetermined temperature and a memory means for memorizing a value of reduction in room temperature, wherein said defrosting means starts the defrosting operation by the actuation of said four-way valve when a signal from said refrigerant temperature detector is given and a room temperature reaches said predetermined temperature, said temperature increasing means increases said predetermined temperature before said defrosting operation is started, and said memory means stores a value of reduction in room temperature during the defrosting operation as an increment value to use it for the next operation.

7. The air conditioning apparatus according to claim 6, wherein said temperature increasing means has an upper limit of temperature.

* * * * *